US009361900B2

(12) United States Patent
Yamamoto et al.

(10) Patent No.: US 9,361,900 B2
(45) Date of Patent: Jun. 7, 2016

(54) ENCODING DEVICE AND METHOD, DECODING DEVICE AND METHOD, AND PROGRAM

(75) Inventors: Yuki Yamamoto, Tokyo (JP); Toru Chinen, Kanagawa (JP)

(73) Assignee: Sony Corporation, Tokyo (JP)

( * ) Notice: Subject to any disclaimer, the term of this patent is extended or adjusted under 35 U.S.C. 154(b) by 155 days.

(21) Appl. No.: 14/237,990

(22) PCT Filed: Aug. 14, 2012

(86) PCT No.: PCT/JP2012/070684

§ 371 (c)(1),
(2), (4) Date: Feb. 10, 2014

(87) PCT Pub. No.: WO2013/027631

PCT Pub. Date: Feb. 28, 2013

(65) Prior Publication Data

US 2014/0200900 A1 Jul. 17, 2014

(30) Foreign Application Priority Data

Aug. 24, 2011 (JP) ..... 2011-182450

(51) Int. Cl.
*G10L 19/00* (2013.01)
*G10L 21/00* (2013.01)
(Continued)

(52) U.S. Cl.
CPC ..... *G10L 19/265* (2013.01); *G10L 21/038* (2013.01)

(58) Field of Classification Search
None
See application file for complete search history.

(56) References Cited

U.S. PATENT DOCUMENTS 8,144,804 B2 * 3/2012 Chinen ..... H04L 27/00 375/295
8,332,210 B2 * 12/2012 Nilsson ..... G10L 21/038 704/200

(Continued)

FOREIGN PATENT DOCUMENTS

CA 2775387 A1 4/2011
EP 2317509 A1 5/2011

(Continued)

OTHER PUBLICATIONS

Chinen et al., Report on PVC CE for SBR in USAC, Motion Picture Expert Group Meeting, Oct. 28, 2010, ISO/IEC JTC1/SC29/WG11, No. M18399, 47 pages.

*Primary Examiner* — Satwant Singh
(74) *Attorney, Agent, or Firm* — Wolf, Greenfield & Sacks, P.C.

(57) ABSTRACT

The present technology relates to an encoding device and method, a decoding device and method, and a program, which enable improvement of audio quality.
A QMF sub-band power calculation unit calculates power of a QMF sub-band signal of a high frequency QMF sub-band among a plurality of the QMF sub-bands constituting an input signal. A high frequency sub-band power calculation unit carries out an operation to weight more a QMF sub-band power having larger power as for a sub-band including a number of the high frequency QMF sub-bands to calculate high frequency sub-band power of the sub-band. The multiplexing circuit multiplexes high frequency encoded data and low frequency encoded data for outputting. The high frequency encoded data is selected based on the high frequency sub-band power and obtained by encoding information used for obtaining a high frequency component of the input signal by estimating, and the low frequency encoded data is obtained by encoding low frequency components of the input signal. The present technology can be applied to encoding devices.

17 Claims, 6 Drawing Sheets

(51) Int. Cl.
*G10L 19/26* (2013.01)
*G10L 21/038* (2013.01)

(56) References Cited

U.S. PATENT DOCUMENTS

| | | | | |
|---|---|---|---|---|
| 8,340,213 | B2 * | 12/2012 | Chinen | H04L 27/00 375/295 |
| 8,386,243 | B2 * | 2/2013 | Nilsson | G10L 21/038 704/200 |
| 8,498,344 | B2 * | 7/2013 | Wilson | H04L 25/4915 341/51 |
| 8,560,330 | B2 * | 10/2013 | Gao | G10L 21/038 704/208 |
| 8,949,119 | B2 | 2/2015 | Yamamoto et al. | |
| 8,972,248 | B2 * | 3/2015 | Otani | G10L 21/038 381/102 |
| 9,047,875 | B2 * | 6/2015 | Gao | G10L 21/038 |
| 9,177,563 | B2 * | 11/2015 | Yamamoto | G10L 19/008 |
| 9,208,795 | B2 * | 12/2015 | Yamamoto | G10L 19/0208 |
| 2007/0040709 | A1 * | 2/2007 | Sung | G10L 19/0208 341/50 |
| 2008/0270125 | A1 | 10/2008 | Choo et al. | |
| 2011/0137659 | A1 * | 6/2011 | Honma | G10L 21/038 704/500 |
| 2012/0243526 | A1 | 9/2012 | Yamamoto et al. | |
| 2013/0028427 | A1 | 1/2013 | Yamamoto et al. | |
| 2013/0030818 | A1 | 1/2013 | Yamamoto et al. | |
| 2013/0124214 | A1 | 5/2013 | Yamamoto et al. | |
| 2013/0202118 | A1 | 8/2013 | Yamamoto et al. | |
| 2013/0208902 | A1 | 8/2013 | Yamamoto et al. | |
| 2014/0006037 | A1 | 1/2014 | Honma et al. | |
| 2014/0172433 | A2 | 6/2014 | Honma et al. | |
| 2014/0200899 | A1 * | 7/2014 | Yamamoto | G10L 19/265 704/500 |
| 2014/0205101 | A1 * | 7/2014 | Yamamoto | G10L 19/0208 381/22 |
| 2015/0051904 | A1 * | 2/2015 | Kikuiri | G10L 19/265 704/205 |
| 2015/0120307 | A1 | 4/2015 | Yamamoto et al. | |
| 2016/0012829 | A1 * | 1/2016 | Yamamoto | G10L 19/008 381/98 |
| 2016/0019911 | A1 * | 1/2016 | Yamamoto | G10L 19/0208 704/500 |

FOREIGN PATENT DOCUMENTS

| | | |
|---|---|---|
| JP | 2001-521648 | 11/2001 |
| JP | 2007-333785 | 12/2007 |
| JP | 2008-139844 | 6/2008 |
| JP | 2010-020251 | 1/2010 |
| JP | 2010-079275 | 4/2010 |
| JP | 2010-526331 A | 7/2010 |
| WO | WO 2005/111568 | 11/2005 |
| WO | WO 2006/049205 | 5/2006 |
| WO | WO 2011/043227 | 4/2011 |

* cited by examiner

ENCODING DEVICE AND METHOD, DECODING DEVICE AND METHOD, AND PROGRAM

CROSS REFERENCE TO RELATED APPLICATIONS

This is a U.S. National Stage Application under 35 U.S.C. §371, based on International Application No. PCT/JP2012/070684, filed Aug. 14, 2012, which claims priority to Japanese Patent Application JP 2011-182450, filed May Aug. 24, 2011, each of which is hereby incorporated by reference in its entirety.

TECHNICAL FIELD

The present invention relates to an encoding device and method, a decoding device and method, and a program, particularly the encoding device and method, the decoding device and method, and the program, which enable improvement of audio quality.

BACKGROUND ART

As an audio signal encoding method in the related art, HE-AAC (High Efficiency MPEG (Moving Picture Experts Group) 4 AAC (Advanced Audio Coding)) (International Standard ISO/IEC 14496-3) is known.

In this encoding method, a high frequency feature encoding technology called SBR (Spectral Band Replication) is used (refer to Patent Document 1, for example). According to the SBR, when an audio signal is encoded, SBR information for generating a high frequency component of the audio signal is output together with a low frequency component of the encoded audio signal. More specifically, the SBR information is obtained by quantizing power (energy) of each frequency band called a scale factor band of the high frequency component.

Further, in a decoding device, while the low frequency component of the encoded audio signal is decoded, a high frequency signal is generated using a low frequency signal obtained from the decoding, and the SBR information. As a result, an audio signal including the low frequency signal and the high frequency signal is obtained.

CITATION LIST

Patent Document

Patent Document 1: Japanese Patent Application National Publication (Laid-Open) No. 2001-521648

SUMMARY OF THE INVENTION

Problems to be Solved by the Invention

However, in the above technology, the power of an original signal sometimes may not be reproduced at the time of decoding because a mean value of the power of each of frequency bands constituting a high frequency scale factor band is deemed as the power of the scale factor band. In such a case, clarity of the audio signal obtained from the decoding is diminished and audio quality on audibility is degraded.

The present technology is achieved in view of the above situation and intended to enable improvement of the audio quality.

Solutions to Problems

An encoding device according to a first aspect of the present technology includes: a sub-band dividing unit configured to divide a frequency band of an input signal and generate a first sub-band signal of a first sub-band on a high frequency side of the input signal; a first sub-band power calculation unit configured to calculate first sub-band power of the first sub-band signal based on the first sub-band signal; a second sub-band power calculation unit configured to carry out an operation to weight more the first sub-band power having larger power, and calculate second sub-band power of a second sub-band signal including a number of the continuous first sub-bands; a generating unit configured to generate data to obtain, by estimating, a high frequency signal of the input signal based on the second sub-band power; a low frequency encoding unit configured to encode a low frequency signal of the input signal to generate low frequency encoded data; and a multiplexing unit configured to multiplex the data and the low frequency encoded data to generate an output code string.

The encoding device further includes a pseudo high frequency sub-band power calculation unit configured to calculate pseudo high frequency sub-band power which is an estimated value of the second sub-band power based on the input signal or a feature amount obtained from the low frequency signal, and the generating unit can generate the data by comparing the second sub-band power with the pseudo high frequency sub-band power.

The pseudo high frequency sub-band power calculation unit can calculate the pseudo high frequency sub-band power based on the feature amount and an estimating coefficient preliminarily prepared, and the generating unit can generate the data to obtain any one of a plurality of the estimating coefficients.

The encoding device further includes a high frequency encoding unit configured to generate high frequency encoded data by encoding the data, and the multiplexing unit can multiplex the high frequency encoded data and the low frequency encoded data to generate the output code string.

The second sub-band power calculation unit can calculate the second sub-band power by raising a mean value of the first sub-band power raised by the exponent of m by the exponent of 1/m.

The second sub-band power calculation unit can calculate the second sub-band power by obtaining a weighted mean value of the first sub-band power, using the weight which becomes larger as the first sub-band power becomes larger.

An encoding method or program according to the first aspect of the present technology includes steps of: dividing a frequency band of an input signal and generating a first sub-band signal of a first sub-band on a high frequency side of the input signal; calculating first sub-band power of the first sub-band signal based on the first sub-band signal; carrying out an operation to weight more the first sub-band power having higher power, and calculating second sub-band power of a second sub-band signal including a number of the continuous first sub-bands; generating data to obtain, by estimating, a high frequency signal of the input signal based on the second sub-band power; encoding a low frequency signal of the input signal to generate low frequency encoded data; and multiplexing the data and the low frequency encoded data to generate an output code string.

According to the first aspect of the present technology, a frequency band of an input signal is divided, and a first sub-band signal of a first sub-band on a high frequency side of the input signal is generated; first sub-band power of the first sub-band signal is calculated based on the first sub-band signal; an operation is carried out to weight more the first sub-band power having larger power, and second sub-band power of a second sub-band signal including a number of the continuous first sub-bands is calculated; data to obtain, by estimating, a high frequency signal of the input signal based on the second sub-band power is generated; a low frequency signal of the input signal is encoded and low frequency encoded data is generated; and the data and the low frequency encoded data are multiplexed and an output code string is generated.

A decoding device according to a second aspect of the present technology includes: a demultiplexing unit configured to demultiplex an input code string into data and low frequency encoded data, wherein the data is generated based on second sub-band power of a second sub-band signal including a number of the continuous first sub-bands on a high frequency side of an input signal, the second sub-band power is calculated by weighting more first sub-band power having larger power among first sub-band power of the first sub-bands and used for obtaining, by estimating, a high frequency signal of the input signal, and the low frequency encoded data is obtained by encoding the low frequency signal of the input signal; a low frequency decoding unit configured to decode the low frequency encoded data to generate a low frequency signal; a high frequency signal generating unit configured to generate a high frequency signal based on an estimating coefficient obtained from the data and the low frequency signal obtained from the decoding; and a synthesizing unit configured to generate an output signal based on the generated high frequency signal and the low frequency signal obtained from the decoding.

The high frequency signal generating unit can calculate an estimated value of the second sub-band power based on a feature amount acquired from the low frequency signal obtained from the decoding and the estimating coefficient, and generate a high frequency signal based on the estimated value of the second sub-band power and the low frequency signal obtained from the decoding.

The decoding device can further include a high frequency decoding unit configured to decode the data to obtain the estimating coefficient.

Pseudo high frequency sub-band power which is an estimated value of the second sub-band power is calculated based on the input signal or the feature amount obtained from the low frequency signal of the input signal, and the data can be generated by comparing the second sub-band power with the pseudo high frequency sub-band power.

The pseudo high frequency sub-band power is calculated based on the input signal or the feature amount obtained from low frequency signal of the input signal and the estimating coefficient preliminarily prepared, and the data to obtain any one of a plurality of the estimating coefficients can be generated.

The second sub-band power can be calculated by raising a mean value of the first sub-band power raised by the exponent of m by the exponent of 1/m.

The second sub-band power can be calculated by obtaining a weighted mean value of the first sub-band power, using the weight which becomes larger as the first sub-band power becomes larger.

A decoding method or program according to the second aspect of the present technology includes steps of: demultiplexing an input code string into data and low frequency encoded data, wherein the data is generated based on second sub-band power of a second sub-band signal including a number of the continuous first sub-bands on a high frequency side of an input signal, the second sub-band power is calculated by weighting more first sub-band power having larger power among first sub-band power of the first sub-bands and used for obtaining, by estimating, a high frequency signal of the input signal, and the low frequency encoded data is obtained by encoding the low frequency signal of the input signal; decoding the low frequency encoded data to generate a low frequency signal; generating a high frequency signal based on an estimating coefficient obtained from the data and the low frequency signal obtained from the decoding; and generating an output signal based on the generated high frequency signal and the low frequency signal obtained from the decoding.

According to the second aspect of the present technology, an input code string is demultiplexed into data and low frequency encoded data, wherein the data is generated based on second sub-band power of a second sub-band signal including a number of the continuous first sub-bands on a high frequency side of an input signal, the second sub-band power is calculated by weighting more first sub-band power having larger power among first sub-band power of the first sub-bands and used for obtaining, by estimating, a high frequency signal of the input signal, and the low frequency encoded data is obtained by encoding the low frequency signal of the input signal; the low frequency encoded data is decoded and a low frequency signal is generated; a high frequency signal is generated based on an estimating coefficient obtained from the data and the low frequency signal obtained from the decoding; and an output signal is generated based on the generated high frequency signal and the low frequency signal obtained from the decoding.

Effects of the Invention

According to the first aspect and the second aspect of the present technology, audio quality can be improved.

MODES FOR CARRYING OUT THE INVENTION

Hereinafter, embodiments in which the present technology is applied will be described with reference to the drawings.

Overview of Present Technology

[Encoding Input Signal]

The present technology is adopted to encode an input signal, for instance, an audio signal such as a music signal as an input signal.

Figure 1:
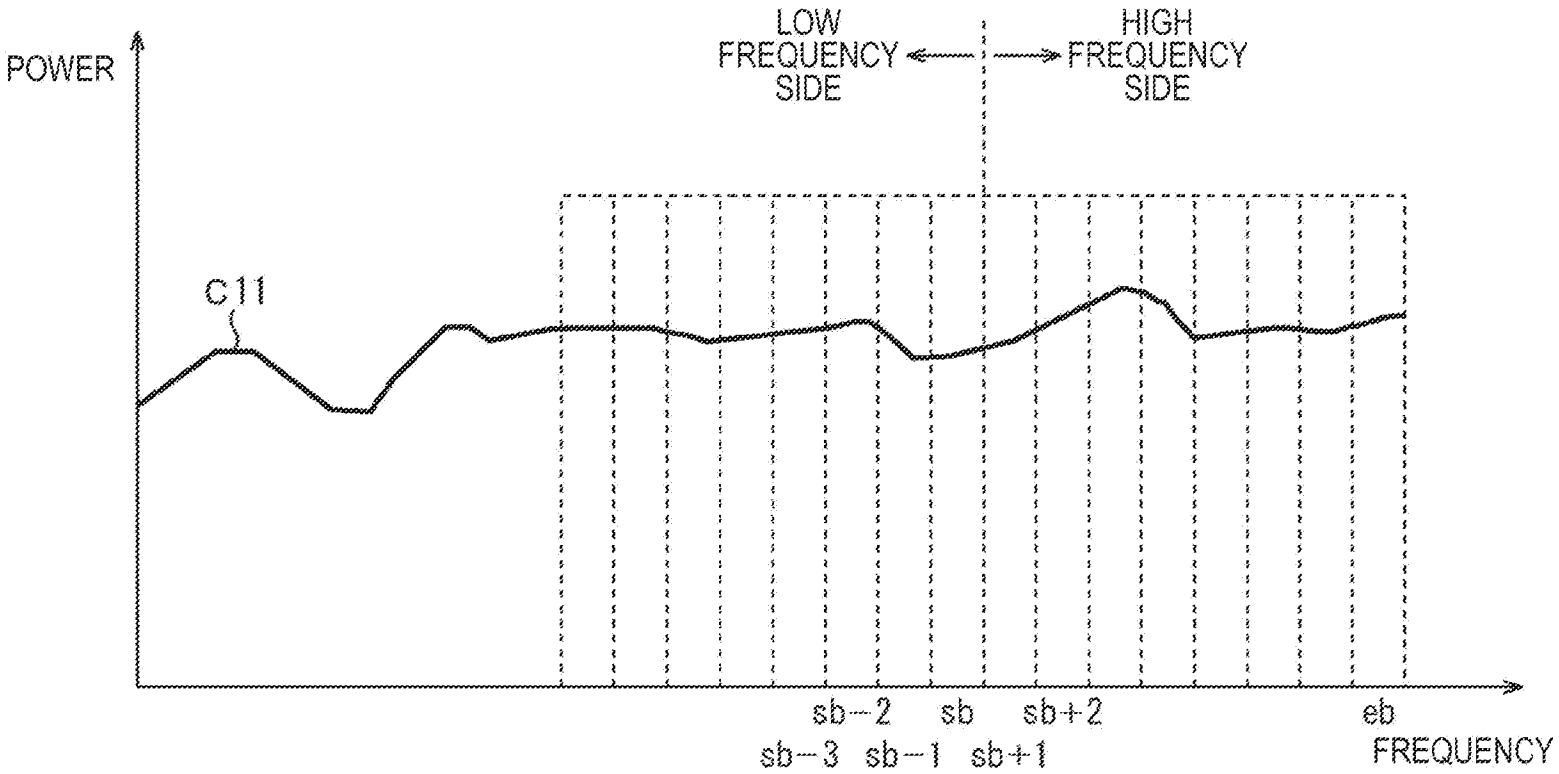
FIG. 1 is a diagram for describing a sub-band of an input signal.

In an encoding device which encodes the input signal, at the time of encoding, the input signal is divided into sub-band signals of a plurality of frequency bands (hereinafter referred to as sub-band) each having a predetermined bandwidth as illustrated in FIG. 1. Note that, in FIG. 1, the vertical axis represents power of respective frequencies of the input signal, and the horizontal axis represents respective frequencies of the input signal. Further, a curve C11 represents the power of respective frequency components of the input signal, and in the drawing, vertical dotted lines represent boundary positions of the respective sub-bands.

In the encoding device, components lower than a predetermined frequency among the frequency components of the input signal on the low frequency side are encoded by a predetermined encoding system, thereby generating low frequency encoded data.

In the example of FIG. 1, the sub-bands of the frequencies equal to or lower than an upper limit frequency of a sub-band sb having an index sb are regarded as the low frequency components of the input signal, and the sub-bands of the frequencies higher than the upper limit frequency of the sub-band sb are regarded as the high frequency components of the input signal. Note that the index specifies each of the sub-bands.

After the low frequency encoded data is obtained, information to reproduce a sub-band signal of each of the sub-bands of the high frequency components is subsequently generated based on the low frequency components and the high frequency components of the input signal. Then, the information is timely encoded by the predetermined encoding system, and the high frequency encoded data is generated.

More specifically, the high frequency encoded data is generated from: the components of four sub-bands sb−3 to sb arrayed continuously in a frequency direction and having the highest frequencies on the low frequency side; and the components of (eb−(sb+1)+1) numbers of the sub-bands sb+1 to eb continuously arrayed on the high frequency side.

Here, the sub-band sb+1 is adjacent to the sub-band sb and the highest frequency sub-band positioned on the low frequency side, and the sub-band eb is the highest frequency sub-band of the sub-bands sb+1 to eb continuously arrayed.

The high frequency encoded data obtained by encoding the high frequency components is information to generate, by estimating, a sub-band signal of a sub-band ib (where $sb+1 \leq ib \leq eb$) on the high frequency side. The high frequency encoded data includes a coefficient index to obtain an estimating coefficient used to estimate each of the sub-band signals.

More specifically, the estimating coefficient including a coefficient $A_{ib}(kb)$ and a coefficient $B_{ib}$ is used to estimate the sub-band signal of the sub-band ib. The coefficient $A_{ib}(kb)$ is multiplied with the power of the sub-band signal of a sub-band kb (where $sb-3 \leq kb \leq sb$) on the low frequency side, and the coefficient $B_{ib}$ is a constant term. The coefficient index included in the high frequency encoded data is information to obtain a set of the estimating coefficients including the coefficient $A_{ib}(kb)$ and the coefficient $B_{ib}$ of each of the sub-band ib, e.g., the information to specify the set of the estimating coefficients.

More specifically, when the high frequency encoded data is generated, the power of the sub-band signal of each sub-band kb on the low frequency side (hereinafter, referred to as low frequency sub-band power) is multiplied by the coefficient $A_{ib}(kb)$. Further, the coefficient $B_{ib}$ is added to a total sum of the low frequency sub-band power multiplied by the coefficient $A_{ib}(kb)$ to calculate a pseudo high frequency sub-band power which is an estimated value of power of the sub-band signal of the sub-band ib on the high frequency side.

Additionally, the pseudo high frequency sub-band power of each of the sub-bands on the high frequency side is compared with the power of the sub-band signal of each of the sub-bands on an actual high frequency side. Based on the comparison result, an optimal estimating coefficient is selected, and the data including a coefficient index of the selected estimating coefficient is encoded to obtain high frequency encoded data.

After thus obtaining the low frequency encoded data and the high frequency encoded data, these low frequency encoded data and high frequency encoded data are multiplexed, and an output code string is obtained to be output.

Further, a decoding device that has received the output code string decodes the low frequency encoded data to obtain a decoded low frequency signal including a sub-band signal of each of the sub-bands on the low frequency side, and also generates, by estimating, a sub-band signal of each of the sub-bands on the high frequency side from the decoded low frequency signal and information obtained by decoding the high frequency encoded data. Subsequently, the decoding device generates an output signal from the decoded low frequency signal and the decoded high frequency signal which includes the sub-band signal of each of the sub-bands on the high frequency side obtained by estimating. The output signal thus obtained is a signal obtained by decoding the encoded input signal.

[QMF Sub-Band]

Incidentally, as described above, the input signal is divided into the components of each of the sub-bands for the processes in the encoding device, but more specifically, the power of each of the sub-bands is calculated from components of frequency bands each having bandwidth narrower than that of the sub-band.

Figure 2:
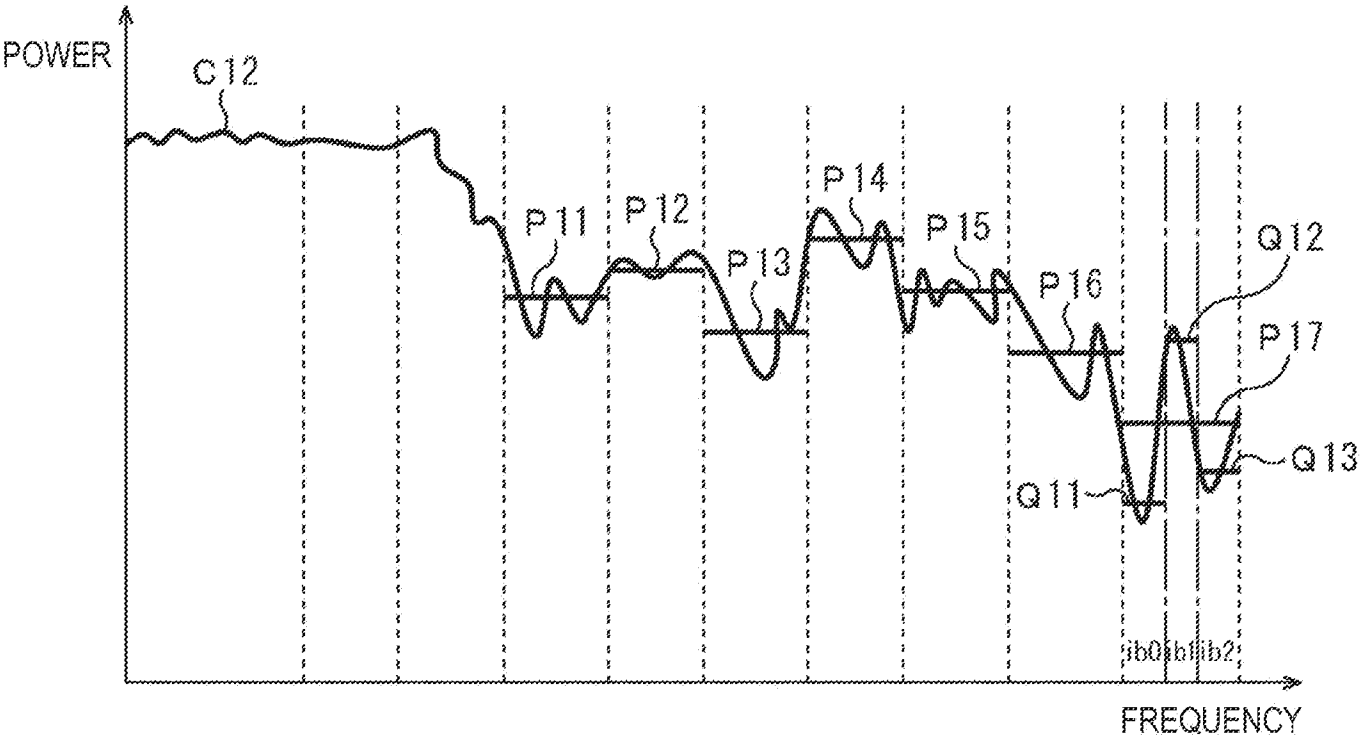
FIG. 2 is a diagram for describing the sub-band and a QMF sub-band.

For example, as illustrated in FIG. 2, in the encoding device, the input signal is divided into QMF sub-band signals (hereinafter referred to as QMF sub-band signal) each having the bandwidth narrower than the bandwidth of each of the above sub-bands by filter processing using a QMF (Quadrature Mirror Filter) analysis filter. Then, one sub-band is formed by bundling a number of the QMF sub-bands.

Note that, in FIG. 2, the vertical axis represents the power of the respective frequencies of the input signal, and the horizontal axis represents the respective frequencies of the input signal. Further, a curve C12 represents the power of the respective frequency components of the input signal, and in the drawing, the vertical dotted lines represent the boundary positions of the respective sub-bands.

In the example of FIG. 2, P11 to P17 each represent the power of each of the sub-bands (hereinafter, also referred to as sub-band power). For example, one sub-band is formed of three QMF sub-bands ib0 to ib2 as illustrated on the right side of the drawing.

Accordingly, in the case of calculating the sub-band power P17, for example, the power of each of the QMF sub-bands ib0 to ib2 (hereinafter referred to as QMF sub-band power) constituting the sub-band is calculated first. More specifically, QMF sub-band power Q11 to Q13 are calculated for the QMF sub-bands ib0 to ib2.

Subsequently, the sub-band power P17 is calculated based on the QMF sub-band power Q11 to Q13.

More concretely, assume that a QMF sub-band signal of a frame J having an index $ib_{QMF}$ is $sig_{QMF}(ib_{QMF},n)$, and the number of samples of a QMF sub-band signal per frame is $FSIZE_{QMF}$, for example. Here, the index $ib_{QMF}$ corresponds to indexes ib0, ib1, ib2 in FIG. 2.

In this case, the QMF sub-band power $power_{QMF}(ib_{QMF},J)$ of the QMF sub-band $ib_{QMF}$ is obtained by the following Expression (1).

[Expression 1]

$$\text{power}_{QMF}(ib_{QMF}, J) = \sum_{n=J\times FSIZE_{QMF}}^{(J+1)\times FSIZE_{QMF}-1} |sig_{QMF}(ib_{QMF}, n)|^2 / FSIZE_{QMF} \quad (1)$$

In other words, the QMF sub-band power $\text{power}_{QMF}(\text{ib}_{QMF},\text{J})$ is obtained by a mean square value of a sample value of each sample of the QMF sub-band signal of the frame J. Note that n in the QMF sub-band signal $\text{sig}_{QMF}(\text{ib}_{QMF},\text{n})$ represents an index of a discrete time.

Further, as a method of obtaining the sub-band power of the sub-band ib on the high frequency side from the QMF sub-band power $\text{power}_{QMF}(\text{ib}_{QMF},\text{J})$ of each of the QMF sub-bands, a method of calculating sub-band power power(ib,J) by the following Expression (2) may be considered.

[Expression 2]

$$\text{power}(ib, J) = 10\times\log_{10}\left\{\sum_{ib_{QMF}=start(ib)}^{end(ib)} \text{power}_{QMF}(ib_{QMF}, J)/(\text{end}(ib) - \text{start}(ib) + 1)\right\} \quad (2)$$

Note that, in Expression (2), start (ib) and end (ib) respectively represent indexes of a QMF sub-band having the lowest frequency and a QMF sub-band having the highest frequency among the QMF sub-bands constituting the sub-band ib. For instance, in the example of FIG. 2, in the case where the sub-band on the extreme right has the index ib, start(ib)=ib0, and end(ib)=ib2.

Therefore, the sub-band power power(ib,J) is obtained by transforming a mean value of the QMF sub-band power of each of the QMF sub-bands constituting the sub-band ib into a logarithmic value.

In the case where the sub-band power is obtained from the operation in Expression (2), the sub-band power P17, for example, is calculated by transforming the mean value of the QMF sub-band power Q11 to Q13 into the logarithmic value. In such a case, the sub-band power P17 is, for example, larger than the QMF sub-band power Q11 and QMF sub-band power Q13, and smaller than the QMF sub-band power Q12 as illustrated in FIG. 2.

At the time of encoding, the sub-band power of each of the sub-bands on the high frequency side (hereinafter referred to as high frequency sub-band power) is compared with the pseudo high frequency sub-band power, and an estimating coefficient is selected such that the pseudo high frequency sub-band power closest to the high frequency sub-band power can be obtained. Further, a coefficient index of the selected estimating coefficient is included in the high frequency encoded data.

On the decoding side, pseudo high frequency sub-band power of each of the sub-bands on the high frequency side is generated from the low frequency sub-band power and the estimating coefficient specified by the coefficient index included in the high frequency encoded data. Then, the sub-band signal of each of the sub-bands on the high frequency side is obtained from the pseudo high frequency sub-band power by estimating.

However, in the frequency band having the QMF sub-band power Q12 larger than the sub-band power P17 like the QMF sub-band ib1, the power of the original input signal may not be reproduced at the time of decoding. In other words, the power of the original QMF sub-band signal cannot be reproduced. As a result, clarity of the audio signal obtained from the decoding is diminished and audio quality on audibility is degraded.

According to the analysis by the applicant of the present application, it is found that degradation of audio quality can be suppressed by obtaining the sub-band power having a value close to a value of the QMF sub-band power having larger power among the QMF sub-bands constituting each of the sub-bands. The reason is that the QMF sub-band having the larger QMF sub-band power acts a more important part as an element to determine audio quality on audibility.

Accordingly, in the encoding device applying the present technology, an operation is carried out to weight more the QMF sub-band power having larger power at the time of calculating the sub-band power so that the value of the sub-band power becomes closer to the value of the QMF sub-band power having the large power. In this manner, an audio signal close to audio quality of the original input signal can be obtained at the time of decoding. In other words, as for the QMF sub-band having the large QMF sub-band power, the power closer to the power of the original QMF sub-band signal can be reproduced at the time of decoding, and audio quality on audibility is improved.

First Embodiment

[Exemplary Configuration of Encoding Device]

Figure 3:
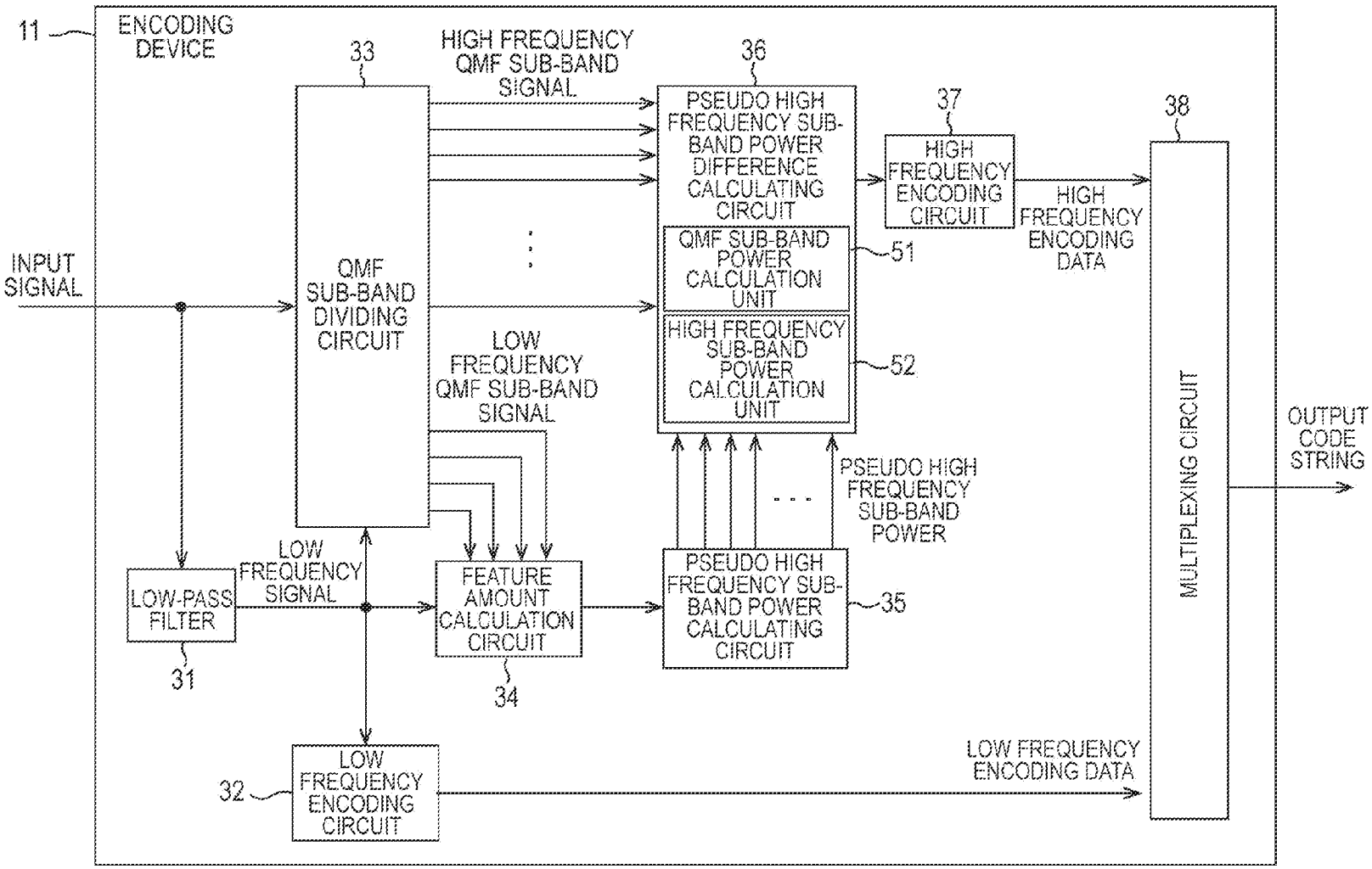
FIG. 3 is a diagram illustrating an exemplary configuration of an encoding device in which the present technology is applied.

Next, a concrete embodiment of the input signal encoding technology described above will be described. First, configuration of an encoding device which encodes an input signal will be described. FIG. 3 is a diagram illustrating an exemplary configuration of the encoding device.

An encoding device 11 includes, a low-pass filter 31, a low frequency encoding circuit 32, a QMF sub-band dividing circuit 33, a feature amount calculating circuit 34, a pseudo high frequency sub-band power calculating circuit 35, a pseudo high frequency sub-band power difference calculating circuit 36, a high frequency encoding circuit 37, and a multiplexing circuit 38. In the encoding device 11, an input signal to be encoded is supplied to the low-pass filter 31 and QMF sub-band dividing circuit 33.

The low-pass filter 31 filters the supplied input signal with a predetermined cutoff frequency, and supplies the signal obtained as a result thereof and having the frequency lower than the cutoff frequency (hereafter referred to as low frequency signal) to the low frequency encoding circuit 32, QMF sub-band dividing circuit 33, and feature amount calculating circuit 34.

The low frequency encoding circuit 32 encodes the low frequency signal from the low-pass filter 31, and supplies the low frequency encoded data obtained as a result thereof to the multiplexing circuit 38.

The QMF sub-band dividing circuit 33 divides the low frequency signal from the low-pass filter 31 into a plurality of equal QMF sub-band signals, and supplies thus obtained QMF sub-band signals (hereinafter also referred to as low frequency QMF sub-band signal) to the feature amount calculating circuit 34.

Further, the QMF sub-band dividing circuit 33 divides the supplied input signal into a plurality of equal QMF sub-band signals, and supplies, to the pseudo high frequency sub-band power difference calculating circuit 36, a QMF sub-band signal of each of the QMF sub-bands included in a predetermined frequency band on the high frequency side among the QMF sub-band signals obtained as a result thereof. Note that, hereinafter, the QMF sub-band signal of each of the QMF sub-bands supplied from the QMF sub-band dividing circuit 33 to the pseudo high frequency sub-band power difference calculating circuit 36 is also referred to as a high frequency QMF sub-band signal.

The feature amount calculating circuit 34 calculates a feature amount based on at least any one of the low frequency signal from the low-pass filter 31, and the low frequency QMF sub-band signal from the QMF sub-band dividing circuit 33, to supply to the pseudo high frequency sub-band power calculating circuit 35.

Based on the feature amount from the feature amount calculating circuit 34, the pseudo high frequency sub-band power calculating circuit 35 calculates pseudo high frequency sub-band power which is an estimated value of the power of the sub-band signal of each of the sub-bands on the high frequency side (hereinafter also referred to as high frequency sub-band signal) to supply to the pseudo high frequency sub-band power difference calculating circuit 36. Incidentally, a plurality of set of estimating coefficients obtained from statistical learning is recorded in the pseudo high frequency sub-band power calculating circuit 35. The pseudo high frequency sub-band power is calculated based on the estimating coefficients and the feature amount.

The pseudo high frequency sub-band power difference calculating circuit 36 selects an optimal estimating coefficient from among a plurality of the estimating coefficients based on the high frequency QMF sub-band signal from the QMF sub-band dividing circuit 33 and the pseudo high frequency sub-band power from the pseudo high frequency sub-band power calculating circuit 35.

The pseudo high frequency sub-band power difference calculating circuit 36 includes a QMF sub-band power calculation unit 51 and a high frequency sub-band power calculation unit 52.

The QMF sub-band power calculation unit 51 calculates QMF sub-band power of each of the QMF sub-bands on the high frequency side based on a high frequency QMF sub-band signal. The high frequency sub-band power calculation unit 52 calculates high frequency sub-band power of each of the sub-bands on the high frequency side based on the QMF sub-band power.

Further, the pseudo high frequency sub-band power difference calculating circuit 36 calculates an evaluated value indicating a difference between the high frequency component estimated using the estimating coefficient and the actual high frequency component of the input signal, based on the pseudo high frequency sub-band power and the high frequency sub-band power. This evaluated value indicates estimation accuracy by the estimating coefficient as for the high frequency component.

The pseudo high frequency sub-band power difference calculating circuit 36 selects one estimating coefficient from the plurality of estimating coefficients based on the evaluated value obtained for each estimating coefficient, and supplies a coefficient index specifying the selected estimating coefficient to the high frequency encoding circuit 37.

The high frequency encoding circuit 37 encodes the coefficient index supplied from the pseudo high frequency sub-band power difference calculating circuit 36, and supplies the high frequency encoded data obtained as a result thereof to the multiplexing circuit 38. The multiplexing circuit 38 multiplexes the low frequency encoded data from the low frequency encoding circuit 32, and the high frequency encoded data from the high frequency encoding circuit 37, to output as an output code string.

[Description of Encoding Process]

The encoding device 11 illustrated in FIG. 3 receives an input signal, and executes encoding process when encoding the input signal is instructed, and outputs the output code string to the decoding device. In the following, the encoding process by the encoding device 11 will be described with reference to a flowchart in FIG. 4. Note that this encoding process is executed for each frame constituting the input signal.

In step S11, the low-pass filter 31 filters the supplied input signal including a frame to be processed, using a low-pass filter with a predetermined cutoff frequency, and supplies a low frequency signal obtained as a result thereof to the low frequency encoding circuit 32, QMF sub-band dividing circuit 33, and feature amount calculating circuit 34.

In step S12, the low frequency encoding circuit 32 encodes the low frequency signal supplied from the low-pass filter 31, and supplies low frequency encoded data obtained as a result thereof to the multiplexing circuit 38.

In step S13, the QMF sub-band dividing circuit 33 divides the input signal and the low frequency signal into a plurality of equal QMF sub-band signals by executing filtering process using a QMF analysis filter.

In other words, the QMF sub-band dividing circuit 33 divides the supplied input signal into the QMF sub-band signals of the respective QMF sub-bands. Subsequently, the QMF sub-band dividing circuit 33 supplies, to the pseudo high frequency sub-band power difference calculating circuit 36, the high frequency QMF sub-band signal of each of the QMF sub-bands constituting the frequency band from sub-band sb+1 to sub-band eb on the high frequency side, obtained as a result thereof.

Additionally, the QMF sub-band dividing circuit 33 divides the low frequency signal supplied from the low-pass filter 31 into the QMF sub-band signals of the respective QMF sub-bands. Further, the QMF sub-band dividing circuit 33 supplies, to the feature amount calculating circuit 34, the low frequency QMF sub-band signal of each of the QMF sub-bands constituting the frequency band from sub-band sb−3 to sub-band sb on the low frequency side, obtained as a result thereof.

In step S14, the feature amount calculating circuit 34 calculates a feature amount based on at least any one of the low frequency signal from the low-pass filter 31 and the low frequency QMF sub-band signal from the QMF sub-band dividing circuit 33, to supply to the pseudo high frequency sub-band power calculating circuit 35.

For instance, the power of each of the low frequency sub-band signal (low frequency sub-band power) is calculated as the feature amount.

More specifically, the feature amount calculating circuit 34 calculates QMF sub-band power of each of the QMF sub-bands on the low frequency side by executing the same calculation as Expression (1) described above. In other words, the feature amount calculating circuit 34 obtains the mean square value of the sample values of respective samples constituting the low frequency QMF sub-band signals for one frame, to define the QMF sub-band power.

Further, the feature amount calculating circuit 34 calculates sub-band power power(ib,J) of the low frequency sub-band ib (where $sb-3 \leq ib \leq sb$) of the frame J to be processed expressed in decibels by executing the same calculation as Expression (2) described above. In other words, the low frequency sub-band power is calculated by transforming the mean value of the QMF sub-band power of the QMF sub-bands constituting each of the sub-bands into a logarithmic value.

After obtaining the low frequency sub-band power of each low frequency sub-band ib, the feature amount calculating circuit 34 supplies the low frequency sub-band power calculated as the feature amount to the pseudo high frequency sub-band power calculating circuit 35. Then, the process proceeds to step S15.

In step S15, the pseudo high frequency sub-band power calculating circuit 35 calculates the pseudo high frequency sub-band power based on the feature amount supplied from the feature amount calculating circuit 34, to supply to the pseudo high frequency sub-band power difference calculating circuit 36.

More specifically, the pseudo high frequency sub-band power calculating circuit 35 calculates sub-band power $power_{est}(ib,J)$ of each of the sub-bands on the high frequency side by executing calculation shown in the following Expression (3) for each estimating coefficient preliminarily recorded. The sub-band power $power_{est}(ib,J)$ obtained in step S15 is pseudo high frequency sub-band power which is the estimated value of the high frequency sub-band power of the sub-band ib (where $sb+1 \le ib \le eb$) on the high frequency side of the frame J to be processed.

[Expression 3]

$$power_{est}(ib, J) = \left( \sum_{kb=sb-3}^{sb} \{A_{ib}(kb) \times power(kb, J)\} \right) + B_{ib} \quad (sb + 1 \le ib \le eb) \tag{3}$$

Note that, in Expression (3), the coefficient $A_{ib}(kb)$ and coefficient $B_{ib}$ represent a set of the estimating coefficients prepared for the sub-band ib on the high frequency side. More specifically, the coefficient $A_{ib}(kb)$ is a coefficient to be multiplied by low frequency sub-band power power(ib,J) of a sub-band kb (where $sb-3 \le kb \le sb$). The coefficient $B_{ib}$ is a constant term used when the sub-band power of the sub-band kb multiplied with the coefficient $A_{ib}(kb)$ is linearly combined.

Accordingly, pseudo high frequency sub-band power $power_{est}(ib,J)$ of the sub-band ib on the high frequency side is obtained by multiplying the low frequency sub-band power of each of the sub-bands on the low frequency side with the coefficient $A_{ib}(kb)$ for each sub-band, and adding the coefficient $B_{ib}$ to a sum of the low frequency sub-band power multiplied by the coefficient.

In the pseudo high frequency sub-band power calculating circuit 35, the pseudo high frequency sub-band power of each of the sub-bands on the high frequency side is calculated for each estimating coefficient preliminarily recorded. For example, in the case where a set of K estimating coefficients (where $2 \le K$) having the coefficient indexes 1 to K is preliminarily prepared, the pseudo high frequency sub-band power of each of the sub-bands is calculated for the set of K estimating coefficients.

In step S16, the QMF sub-band power calculation unit 51 calculates the QMF sub-band power of each of the QMF sub-bands on the high frequency side based on the high frequency QMF sub-band signal supplied from the QMF sub-band dividing circuit 33. For example, the QMF sub-band power calculation unit 51 calculates the QMF sub-band power $power_{QMF}(ib_{QMF},J)$ of each of the QMF sub-bands on the high frequency side by executing the calculation in Expression (1) described above.

In step S17, the high frequency sub-band power calculation unit 52 calculates the high frequency sub-band power of each of the sub-bands on the high frequency side by executing calculation in the following Expression (4) based on the QMF sub-band power calculated by the QMF sub-band power calculation unit 51.

[Expression 4]

$$power(ib, J) = 10 \times \log_{10} \left\{ \left\{ \sum_{ib_{QMF}=start(ib)}^{end(ib)} (power_{QMF}(ib_{QMF}, J))^3 / (end(ib) - start(ib) + 1) \right\}^{\frac{1}{3}} \right\} \tag{4}$$

Note that, in Expression (4), start (ib) and end (ib) respectively represent indexes of the QMF sub-band having the lowest frequency and the QMF sub-band having the highest frequency among the QMF sub-bands constituting the sub-band ib. Additionally, $power_{QMF}(ib_{QMF},J)$ represents the QMF sub-band power of the QMF sub-band $ib_{QMF}$ constituting the high frequency sub-band ib (where $sb+1 \le ib \le eb$) in the frame J.

Accordingly, in the operation of Expression (4), the mean value of a cubed value of the QMF sub-band power of each of the QMF sub-bands constituting the sub-band ib is obtained, and the obtained mean value is raised by the exponent of ⅓, and further the obtained value is transformed into a logarithmic value. Consequently, the value obtained as a result thereof is determined as the high frequency sub-band power power(ib,J) of the high frequency sub-band ib.

Thus, by raising the QMF sub-band power by the larger exponent at the time of calculating the mean value of the QMF sub-band power, it is possible to calculate a mean value which weights the QMF sub-band power having the larger value. In other words, in the case where the QMF sub-band power is exponentiated at the time of calculating the mean value, a difference between the respective QMF sub-band power becomes large, and therefore, it becomes possible to obtain the mean value which weighs more the QMF sub-band power having the larger value.

As a result, as for the QMF sub-band having the large QMF sub-band power, it is possible to reproduce the power closer to the power of the original QMF sub-band signal at the time of decoding the input signal, thereby improving audio quality on audibility of the audio signal obtained from decoding.

Incidentally, in Expression (4), the QMF sub-band power is raised by the exponent of 3 at the time of calculating the mean value of the QMF sub-band power, but it is also possible to raise the QMF sub-band power by the exponent of m (where $1<m$). In such a case, the mean value of the QMF sub-band power raised by the exponent of m is raised by the exponent of 1/m, and the value obtained as a result thereof is transformed into the logarithmic value, thereby obtaining the high frequency sub-band power.

After thus obtaining the high frequency sub-band power of each of the high frequency sub-bands as well as the pseudo high frequency sub-band power of each of the high frequency sub-bands obtained for each estimating coefficient, the process in step S18 is started, and an evaluated value for each estimating coefficient is calculated.

In other words, in step S18, the pseudo high frequency sub-band power difference calculating circuit 36 calculates an evaluated value Res (id,J) for each of K estimating coefficients, using the current frame J to be processed.

More specifically, the pseudo high frequency sub-band power difference calculating circuit 36 calculates a residual mean square value $Res_{std}$(id,J) by executing calculation in the following Expression (5).

[Expression 5]

$$Res_{std}(id, J) = \sum_{ib=sb+1}^{eb} \{power(ib, J) - power_{est}(ib, id, J)\}^2 / (eb - sb) \quad (5)$$

In other words, as for each sub-band ib (where sb+1≤ib≤eb) on the high frequency side, a difference between the high frequency sub-band power power(ib,J) of the frame J and the pseudo high frequency sub-band power $power_{est}$(ib, id,J) is obtained, and a mean square value of the differences is determined as the residual mean square value $Res_{std}$(id,J).

Note that the pseudo high frequency sub-band power $power_{est}$(ib,id,J) represents the pseudo high frequency sub-band power of the sub-band ib obtained as to the estimating coefficient having the coefficient index id in the frame J.

Subsequently, the pseudo high frequency sub-band power difference calculating circuit 36 calculates a maximum value of the residual difference $Res_{max}$(id,J) by executing calculation in the following Expression (6).

[Expression 6]

$$Res_{max}(id,J)=\max_{ib}\{|power(ib,J)-power_{est}(ib,id,J)|\} \quad (6)$$

Note that, in Expression (6), $\max_{ib}\{|(ib,J)-power_{est}(ib,id,J)|\}$ represents a maximum value of absolute values of the difference between the high frequency sub-band power power(ib,J) of each of the sub-bands ib and the pseudo high frequency sub-band power $power_{est}$(ib,id,J). Therefore, the maximum value of the absolute values of the difference between the high frequency sub-band power power(ib,J) and the pseudo high frequency sub-band power $power_{est}$(ib,id,J) in the frame J is determined as the maximum value of the residual difference $Res_{max}$(id,J).

Additionally, the pseudo high frequency sub-band power difference calculating circuit 36 calculates a residual difference mean value $Res_{ave}$(id,J) by executing calculation in the following Expression (7).

[Expression 7]

$$Res_{ave}(id, J) = \left|\left(\sum_{ib=sb+1}^{eb} \{power(ib, J) - power_{est}(ib, id, J)\}\right) \Big/ (eb - sb)\right| \quad (7)$$

In other words, as for each sub-band ib on the high frequency side, the difference between the high frequency sub-band power power(ib,J) and the pseudo high frequency sub-band power $power_{est}$(ib,id,J) in the frame J is obtained, and a sum of the differences is obtained. Subsequently, the obtained sum of the differences is divided by the number of sub-bands (eb−sb) on the high frequency side, and an absolute value of the value obtained thereof is determined as the residual difference mean value $Res_{ave}$(id,J). This residual difference mean value $Res_{ave}$(id,J) represents the magnitude of the mean value of the estimated difference as to each of the sub-bands considered to be encoded.

Additionally, after obtaining the residual mean square value $Res_{std}$(id,J), the maximum value of the residual difference $Res_{max}$(id,J), and the residual difference mean value $Res_{ave}$(id,J), the pseudo high frequency sub-band power difference calculating circuit 36 calculates a final evaluated value Res (id,J) by executing calculation in the following Expression (8).

[Expression 8]

$$Res(id,J)=W_{std}\times Res_{std}(id,J)+W_{max}\times Res_{max}(id,J)+W_{ave}\times Res_{ave}(id,J) \quad (8)$$

In other words, the residual mean square value $Res_{std}$(id,J), the maximum value of the residual difference $Res_{max}$(id,J), and the residual difference mean value $Res_{ave}$(id,J) are weighted, thereby obtaining the final evaluated value Res(id, J). Note that, in Expression (8), $W_{std}$, $W_{max}$, and $W_{ave}$ are predetermined weights, such as $W_{std}$=1, $W_{max}$=0.5, and $W_{ave}$=0.5.

The pseudo high frequency sub-band power difference calculating circuit 36 calculates the evaluated value Res(id,J) for each of the K estimating coefficients, i.e., each of K coefficient indexes id, by performing the above-described process.

In step S19, the pseudo high frequency sub-band power difference calculating circuit 36 selects a coefficient index id based on the evaluated value Res(id,J) obtained for each of the coefficient indexes id.

The evaluated value Res(id,J) obtained from the process in step S18 indicates the degree of similarity between the high frequency sub-band power calculated from the actual high frequency sub-band signal and the pseudo high frequency sub-band power calculated using the estimating coefficient having the coefficient index id. That is to say, the magnitude of the estimated difference of the high frequency components is indicated.

Therefore, the smaller the evaluated value Res(id,J) is, the more the signal closer to the actual high frequency sub-band signal can be obtained by the operation using the estimating coefficient. Accordingly, the pseudo high frequency sub-band power difference calculating circuit 36 selects a minimum evaluated value from among the K evaluated values Res(id,J), and supplies, to the high frequency encoding circuit 37, the coefficient index representing the estimating coefficient corresponding to the evaluated value.

In step S20, the high frequency encoding circuit 37 encodes the coefficient index supplied from the pseudo high frequency sub-band power difference calculating circuit 36, and supplies the high frequency encoded data obtained as a result thereof to the multiplexing circuit 38.

For example, in step S20, entropy encoding or the like is performed as to the coefficient index. Note that the high frequency encoded data may be any sort of information as long as the information can obtain an optimal estimating coefficient. For example, the coefficient index may be used as the high frequency encoded data, without change.

In step S21, the multiplexing circuit 38 multiplexes the low frequency encoded data supplied from the low frequency encoding circuit 32 and the high frequency encoded data supplied from the high frequency encoding circuit 37, and outputs an output code string obtained as a result thereof, thereby ending the encoding process.

As described above, the encoding device 11 calculates the evaluated value indicating the estimated difference of the high frequency components for each of the recorded estimating coefficients, and selects the estimating coefficient having the minimum evaluated value. Then, the encoding device 11 encodes the coefficient index representing the selected estimating coefficient to obtain the high frequency encoded data, and multiplexes the low frequency encoded data and the high frequency encoded data to obtain the output code string.

Thus, the decoding device that receives the output code string can obtain the most optimal estimating coefficient for estimating the high frequency component by encoding the coefficient index together with the low frequency encoded data and outputting the high frequency encoded data obtained as a result thereof as the output code string. This makes it possible to obtain a signal having higher audio quality.

Moreover, the operation is carried out to weight more the QMF sub-band power having the larger power at the time of calculating the high frequency sub-band power used for calculation of the evaluated value. As a result, at the time of decoding the output code string, it is possible to reproduce the power closer to the power of the original QMF sub-band signal as to the QMF sub-band having the large QMF sub-band power in the input signal. This makes it possible to obtain an audio signal closer to the audio quality of the input signal at the time of decoding, and also improve the audio quality on audibility.

Modified Example

Calculation of Sub-Band Power

Note that the high frequency sub-band power may be calculated by calculating a weighted mean value of the QMF sub-band power although the high frequency sub-band power is calculated by the operation in Expression (4) according to the above description.

Figure 4:
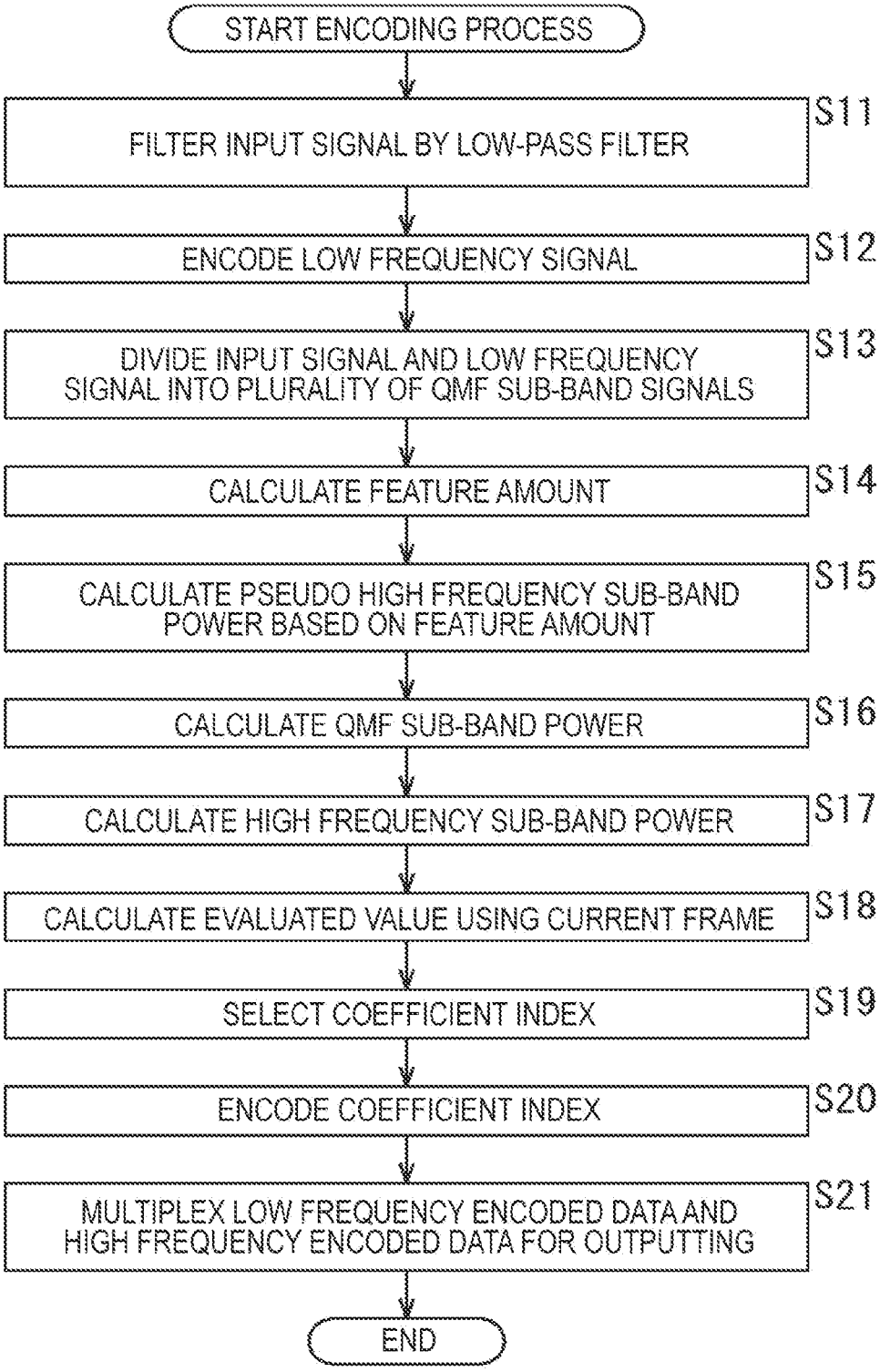
FIG. 4 is a flowchart describing an encoding process.

In such a case, for example, the high frequency sub-band power calculation unit 52 calculates the sub-band power power(ib,J) of the high frequency sub-band ib (where sb+1≤ib≤eb) in the frame J to be processed by executing calculation in the following Expression (9) in step S17 of FIG. 4.

[Expression 9]

$$\text{power}(ib, J) = 10 \times \log_{10}\left\{\sum_{ib_{QMF}=start(ib)}^{end(ib)} W_{QMF}(\text{power}_{QMF}(ib_{QMF}, J)) \times \text{power}_{QMF}(ib_{QMF}, J)/(\text{end}(ib) - \text{start}(ib) + 1)\right\} \quad (9)$$

Note that, in Expression (9), start(ib) and end(ib) respectively represent indexes of a QMF sub-band having the lowest frequency and a QMF sub-band having the highest frequency among the QMF sub-bands constituting the sub-band ib. Additionally, $\text{power}_{QMF}(\text{ib}_{QMF},\text{J})$ represents the QMF sub-band power of the QMF sub-band $\text{ib}_{QMF}$ constituting the high frequency sub-band ib in the frame J.

Further, in Expression (9), $W_{QMF}(\text{power}_{QMF}(\text{ib}_{QMF},\text{J}))$ is the weight that changes in accordance with the magnitude of QMF sub-band power $\text{power}_{QMF}(\text{ib}_{QMF},\text{J})$, and calculation is made as shown in the following Expression (10), for example.

[Expression 10]

$$W_{QMF}(\text{power}_{QMF}(ib_{QMF},J))=0.01\times10\times\log_{10}\{\text{power}_{QMF}(ib_{QMF},J)\}+1 \quad (10)$$

In other words, the larger the QMF sub-band power $\text{power}_{QMF}(\text{ib}_{QMF},\text{J})$ is, the larger the weight $W_{QMF}(\text{power}_{QMF}(\text{ib}_{QMF},\text{J})$ is.

Therefore, in Expression (9), the weight that changes in accordance with the magnitude of the QMF sub-band power is added, and the QMF sub-band power of each of the QMF sub-bands is weighted. Then, the value obtained as a result thereof is divided by the number of the QMF sub-bands (end(ib)−start(ib)+1). Further, the value obtained as a result thereof is transformed into a logarithmic value and determined as the high frequency sub-band power. That is to say, the high frequency sub-band power can be obtained by obtaining the weighted mean value of each of the QMF sub-band power.

In the case where the high frequency sub-band power is obtained by calculating the weighted mean value as described above, the QMF sub-band power of higher power is also weighted more. Therefore, the power closer to the power of an original QMF sub-band signal can be reproduced at the time of decoding the output code string. Therefore, an audio signal closer to the input signal can be obtained at the time of decoding, thereby improving audio quality on audibility.

[Configuration of Decoding Device]

Next, a decoding device which receives the output code string output from the encoding device 11 and decodes the output code string will be described.

Figure 5:
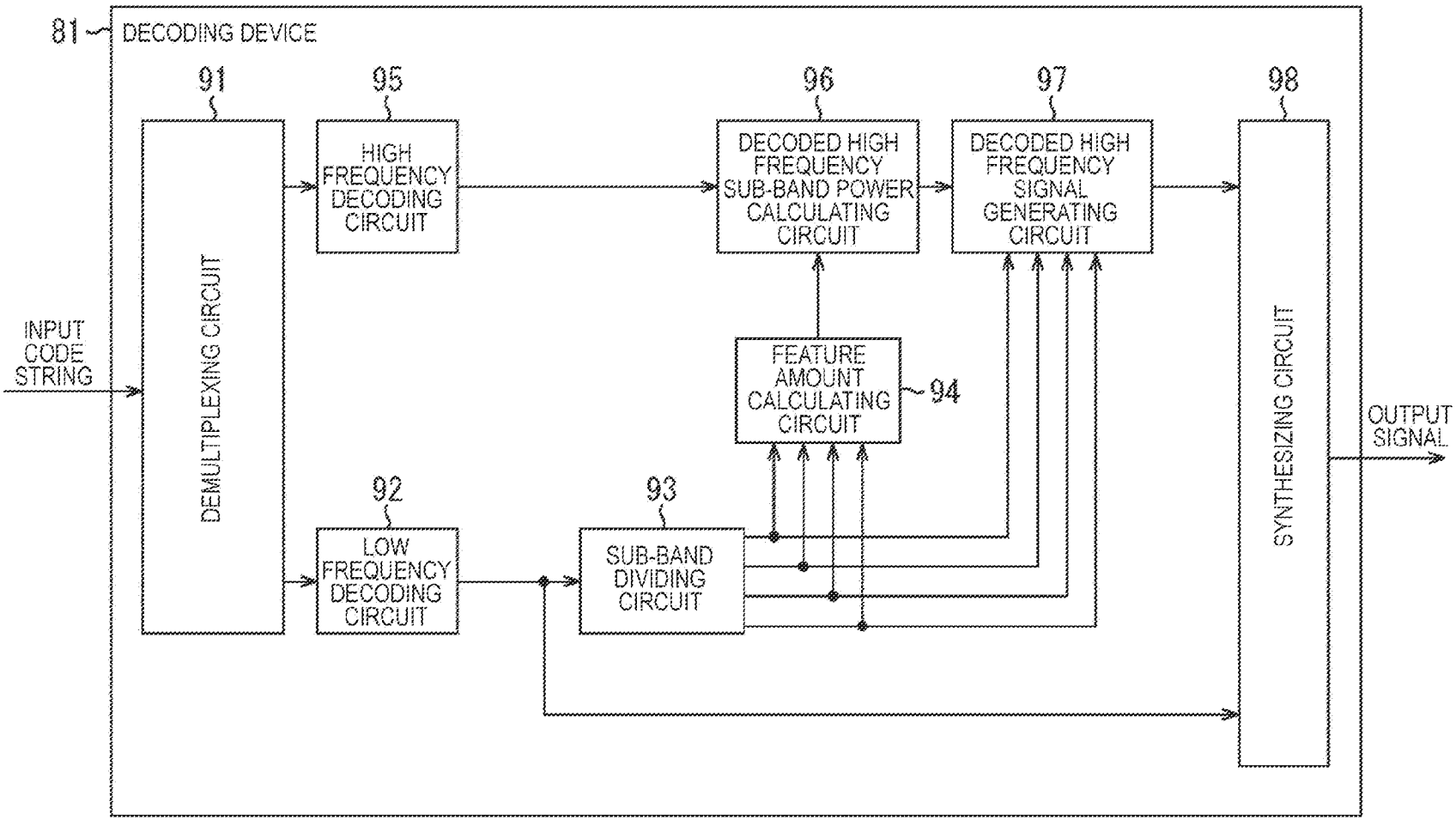
FIG. 5 is a diagram illustrating an exemplary configuration of a decoding device.

Such a decoding device is configured as illustrated in FIG. 5, for example.

A decoding device 81 includes, a demultiplexing circuit 91, a low frequency decoding circuit 92, a sub-band dividing circuit 93, a feature amount calculating circuit 94, a high frequency decoding circuit 95, a decoded high frequency sub-band power calculating circuit 96, a decoded high frequency signal generating circuit 97, and a synthesizing circuit 98.

The demultiplexing circuit 91 receives the output code string from the encoding device 11 as an input code string, and demultiplexes the input code string into high frequency encoded data and low frequency encoded data. Further, the demultiplexing circuit 91 supplies the low frequency encoded data obtained by the demultiplexing to the low frequency decoding circuit 92, and supplies the high frequency encoded data obtained by the demultiplexing to the high frequency decoding circuit 95.

The low frequency decoding circuit 92 decodes the low frequency encoded data from the demultiplexing circuit 91, and supplies the decoded low frequency signal obtained as a result thereof to the sub-band dividing circuit 93 and the synthesizing circuit 98.

The sub-band dividing circuit 93 divides the decoded low frequency signal from the low frequency decoding circuit 92 into a plurality of equal low frequency sub-band signals each having a predetermined bandwidth, and supplies the obtained low frequency sub-band signals to the feature amount calculating circuit 94 and the decoded high frequency signal generating circuit 97.

The feature amount calculating circuit 94 calculates low frequency sub-band power of each of the sub-bands on the low frequency side as a feature amount based on the low frequency sub-band signals from the sub-band dividing circuit 93, and supplies the feature amount to the decoded high frequency sub-band power calculating circuit 96.

The high frequency decoding circuit 95 decodes the high frequency encoded data from the demultiplexing circuit 91, and supplies an estimating coefficient specified by a coefficient index obtained as a result thereof to the decoded high frequency sub-band power calculating circuit 96. In other words, in the high frequency decoding circuit 95, a plurality of coefficient indexes and estimating coefficients specified by the coefficient indexes are preliminarily recorded in a correlated manner, and the high frequency decoding circuit 95 outputs the estimating coefficient corresponding to the coefficient index included in the high frequency encoded data.

Based on the estimating coefficient from the high frequency decoding circuit 95 and the low frequency sub-band power from the feature amount calculating circuit 94, the decoded high frequency sub-band power calculating circuit 96 calculates, for each frame, decoded high frequency sub-band power which is an estimated value of the sub-band power of each of the sub-bands on the high frequency side. For example, the decoded high frequency sub-band power is calculated by carrying out the operation same as the above Expression (3). The decoded high frequency sub-band power calculating circuit 96 supplies the calculated decoded high frequency sub-band power of each of the sub-bands to the decoded high frequency signal generating circuit 97.

The decoded high frequency signal generating circuit 97 generates a decoded high frequency signal based on the low frequency sub-band signal from the sub-band dividing circuit 93 and the decoded high frequency sub-band power from the decoded high frequency sub-band power calculating circuit 96, to supply to the synthesizing circuit 98.

More specifically, the decoded high frequency signal generating circuit 97 calculates the low frequency sub-band power of the low frequency sub-band signal, and modulates amplitude of the low frequency sub-band signal in response to the ratio of the decoded high frequency sub-band power to the low frequency sub-band power. Further, the decoded high frequency signal generating circuit 97 generates a decoded high frequency sub-band signal of each of the sub-bands on the high frequency side by modulating the frequency of the low frequency sub-band signal having the amplitude modulated. The decoded high frequency sub-band signal thus obtained is an estimated value of the high frequency sub-band signal of each of the sub-bands on the high frequency side of the input signal. The decoded high frequency signal generating circuit 97 supplies the decoded high frequency signal including the decoded high frequency sub-band signal obtained for each of the sub-bands to the synthesizing circuit 98.

The synthesizing circuit 98 synthesizes the decoded low frequency signal from the low frequency decoding circuit 92 and the decoded high frequency signal from the decoded high frequency signal generating circuit 97, to output as an output signal. This output signal is obtained by decoding the encoded input signal, and includes the high frequency component and the low frequency component.

Incidentally, the present technology described above may be applied to audio coding system such as HE-AAC (International Standard ISO/IEC 14496-3) and AAC (MPEG2 AAC (Advanced Audio Coding)) (International Standard ISO/IEC13818-7).

In the HE-AAC, a high frequency feature encoding technology called SBR is used. According to SBR, SBR information is output for generating high frequency components of the audio signal together with low frequency components of the encoded audio signal at the time of encoding audio signals as described above.

More specifically, the input signal is divided into a plurality of the QMF sub-band signals of the QMF sub-bands by the QMF analysis filter, and a representative value of the power of each sub-band formed by bundling a plurality of continuous QMF sub-bands is obtained. This representative value of the power corresponds to the high frequency sub-band power calculated in the process of step S17 in FIG. 4.

Further, the SBR information is obtained by quantizing the representative value of the power of each high frequency sub-band, and this SBR information and a bit stream including the low frequency encoded data are output to the decoding device as an output code string.

Additionally, according to the AAC, a time signal is transformed to an MDCT coefficient representing a frequency domain by MDCT (Modified Discrete Cosine Transform), and information of the quantized value expressed in a floating-point number is included in the bit stream. According to the AAC, a frequency band where a plurality of continuous MDCT coefficients is bundled is called a scale factor band.

One scale factor is commonly used for the MDCT coefficient included in each scale factor band as a scale factor (index part) expressed in the floating-point number for the MDCT coefficient.

The encoding device obtains a representative value for each scale factor band from the plurality of the MDCT coefficients, and determines a scale factor value such that the representative value can be properly described, and then the information is included in the bit stream. The present technology can be applied to calculating the representative value to determine the scale factor value for each scale factor band from the plurality of the MDCT coefficients.

Note that the above described series of processes may be executed by hardware and also by software. In the case of executing the series of processes by the software, a program configuring the software thereof is installed from a program recording medium in a computer that has built-in dedicated hardware, or in a general-use personal computer that can execute various types of functions by various types of programs being installed, for example.

Figure 6:
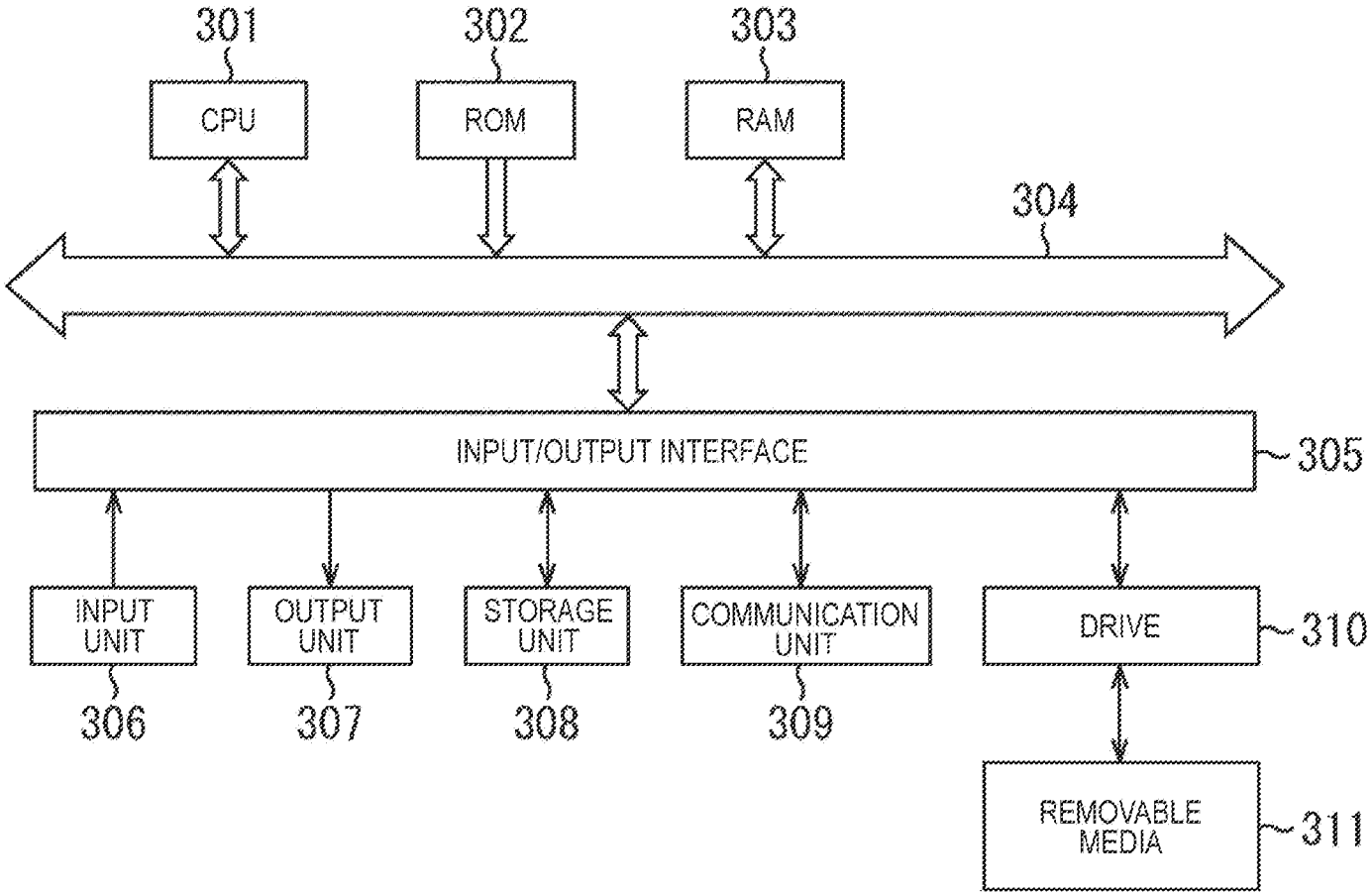
FIG. 6 is a diagram illustrating an exemplary configuration of a computer.

FIG. 6 is a block diagram illustrating an exemplary configuration of the hardware of a computer that executes the above-described series of processes in accordance with the program.

In the computer, a CPU (Central Processing Unit) 301, a ROM (Read Only Memory) 302, and a RAM (Random Access Memory) 303 are connected to one another by a bus 304.

An input/output interface 305 is further connected to the bus 304. The input/output interface 305 is connected to an input unit 306 including a keyboard, a mouse, a microphone or the like, an output unit 307 including a display, a speaker or the like, a recording unit 308 including a hard disk or non-volatile memory or the like, a communication unit 309 including a network interface or the like, and a drive 310 for driving a removable media 311 such as magnetic disc, optical disc, magneto-optical disc, or semiconductor memory or the like.

In a computer configured as described above, the CPU 301 loads a program recorded in the recording unit 308 into the RAM 303 via the input/output interface 305 and the bus 304, and the above described series of processes are performed by executing the program.

The program that the computer (CPU 301) executes is provided by being recorded in removable media 311 which is package media including a magnetic disc (including flexible disc), an optical disc (CD-ROM (Compact Disc-Read Only Memory), a DVD (Digital Versatile Disc) or the like), a magneto-optical disc, or a semiconductor memory or the like, or is provided via a cable or wireless transmission medium such as a local area network, the Internet, or digital satellite broadcast.

The program is installed in the recording unit 308 via the input/output interface 305 by mounting the removable media 311 on the drive 310. Further, the program can be received in the communication unit 309 via a cable or wireless transmission medium, and installed in the recording unit 308. Additionally, the program can be preliminarily installed in the ROM 302 or recording unit 308.

The program to be executed by the computer may be a program for carrying out processes in chronological order in accordance with the sequence described in the present specification, or a program for carrying out processes in parallel or whenever necessary such as in response to a call.

Further, embodiments of the present technology are not limited to the above described embodiments, and various modifications may be made without departing from the scope of the present technology.

Further, the present technology may be configured as follows.

[1]

An encoding device including:

a sub-band dividing unit configured to divide a frequency band of an input signal and generate a first sub-band signal of a first sub-band on a high frequency side of the input signal;

a first sub-band power calculation unit configured to calculate first sub-band power of the first sub-band signal based on the first sub-band signal;

a second sub-band power calculation unit configured to carry out an operation to weight more the first sub-band power having larger power, and calculate second sub-band power of a second sub-band signal including a number of the continuous first sub-bands;

a generating unit configured to generate data to obtain, by estimating, a high frequency signal of the input signal based on the second sub-band power;

a low frequency encoding unit configured to encode a low frequency signal of the input signal and generate low frequency encoded data; and a multiplexing unit configured to multiplex the data and the low frequency encoded data to generate an output code string.

[2]

The encoding device according to [1], further including a pseudo high frequency sub-band power calculation unit configured to calculate pseudo high frequency sub-band power which is an estimated value of the second sub-band power based on the input signal or a feature amount obtained from the low frequency signal, wherein the generating unit generates the data by comparing the second sub-band power with the pseudo high frequency sub-band power.

[3]

The encoding device according to [2], wherein the pseudo high frequency sub-band power calculation unit calculates the pseudo high frequency sub-band power based on the feature amount and an estimating coefficient preliminarily prepared, and the generating unit generates the data to obtain any one of a plurality of the estimating coefficients.

[4]

The encoding device according to any one of [1] to [3], further including a high frequency encoding unit configured to generate high frequency encoded data by encoding the data, wherein the multiplexing unit multiplexes the high frequency encoded data and the low frequency encoded data to generate the output code string.

[5]

The encoding device according to any one of [1] to [4], wherein the second sub-band power calculation unit calculates the second sub-band power by raising a mean value of the first sub-band power raised by the exponent of m by the exponent of 1/m.

[6]

The encoding device according to any one of [1] to [4], wherein the second sub-band power calculation unit calculates the second sub-band power by obtaining a weighted mean value of the first sub-band power, using the weight which becomes larger as the first sub-band power becomes larger.

[7]

An encoding method including steps of:

dividing a frequency band of an input signal and generating a first sub-band signal of a first sub-band on a high frequency side of the input signal;

calculating first sub-band power of the first sub-band signal based on the first sub-band signal;

carrying out an operation to weight more the first sub-band power having larger power, and calculating second sub-band power of a second sub-band signal including a number of the continuous first sub-bands;

generating data to obtain, by estimating, a high frequency signal of the input signal based on the second sub-band power;

encoding a low frequency signal of the input signal to generate low frequency encoded data; and multiplexing the data and the low frequency encoded data to generate an output code string.

[8]

A program causing a computer to execute processes including:

dividing a frequency band of an input signal and generating a first sub-band signal of a first sub-band on a high frequency side of the input signal;

calculating first sub-band power of the first sub-band signal based on the first sub-band signal;

carrying out an operation to weight more the first sub-band power having larger power, and calculating second sub-band power of a second sub-band signal including a number of the continuous first sub-bands;

generating data to obtain, by estimating, a high frequency signal of the input signal based on the second sub-band power;

encoding a low frequency signal of the input signal to generate low frequency encoded data; and multiplexing the data and the low frequency encoded data to generate an output code string.

[9]

A decoding device including:

a demultiplexing unit configured to demultiplex an input code string into data and low frequency encoded data, wherein the data is generated based on second sub-band power of a second sub-band signal including a number of the continuous first sub-bands on a high frequency side of an input signal, the second sub-band power is calculated by weighting more first sub-band power having larger power among first sub-band power of the first sub-bands and used for obtaining, by estimating, a high frequency signal of the input signal, and the low frequency encoded data is obtained by encoding the low frequency signal of the input signal;

a low frequency decoding unit configured to decode the low frequency encoded data to generate a low frequency signal;

a high frequency signal generating unit configured to generate a high frequency signal based on an estimating coefficient obtained from the data and the low frequency signal obtained from the decoding; and a synthesizing unit configured to generate an output signal based on the generated high frequency signal and the low frequency signal obtained from the decoding.

[10]

The decoding device according to [9], wherein the high frequency signal generating unit calculates an estimated value of the second sub-band power based on a feature amount acquired from a low frequency signal obtained from the decoding and the estimating coefficient, and generates a high frequency signal based on the estimated value of the second sub-band power and the low frequency signal obtained from the decoding.

[11]

The decoding device according to [9] or [10], further including a high frequency decoding unit configured to decode the data to obtain the estimating coefficient.

[12]

The decoding device according to any one of [9] to [11], wherein pseudo high frequency sub-band power which is an estimated value of the second sub-band power is calculated based on the input signal or the feature amount obtained from the low frequency signal of the input signal, and the data is generated by comparing the second sub-band power with the pseudo high frequency sub-band power.

[13]

The decoding device according to [12], wherein the pseudo high frequency sub-band power is calculated based on the input signal or the feature amount obtained from the low frequency signal of the input signal and the estimating coefficient preliminarily prepared, and the data is generated to obtain any one of a plurality of the estimating coefficients.

[14]

The decoding device according to any one of [9] to [13], wherein the second sub-band power is calculated by raising a mean value of the first sub-band power raised by the exponent of m by the exponent of 1/m.

[15]

The decoding device according to any one of [9] to [13], wherein the second sub-band power is calculated by obtaining a weighted mean value of the first sub-band power, using the weight which becomes larger as the first sub-band power becomes larger.

[16]

A decoding method including steps of:

demultiplexing an input code string into data and low frequency encoded data, wherein the data is generated based on second sub-band power of a second sub-band signal including a number of the continuous first sub-bands on a high frequency side of an input signal, the second sub-band power is calculated by weighting more first sub-band power having larger power among first sub-band power of the first sub-bands and used for obtaining, by estimating, a high frequency signal of the input signal, and the low frequency encoded data is obtained by encoding the low frequency signal of the input signal;

decoding the low frequency encoded data to generate a low frequency signal;

generating a high frequency signal based on an estimating coefficient obtained from the data and the low frequency signal obtained from the decoding; and generating an output signal based on the generated high frequency signal and the low frequency signal obtained from the decoding.

[17]

A program causing a computer to execute processes including steps of:

demultiplexing an input code string into data and low frequency encoded data, wherein the data is generated based on second sub-band power of a second sub-band signal including a number of the continuous first sub-bands on a high frequency side of an input signal, the second sub-band power is calculated by weighting more first sub-band power having larger power among first sub-band power of the first sub-bands and used for obtaining, by estimating, a high frequency signal of the input signal, and the low frequency encoded data is obtained by encoding the low frequency signal of the input signal;

decoding the low frequency encoded data to generate a low frequency signal;

generating a high frequency signal based on an estimating coefficient obtained from the data and the low frequency signal obtained from the decoding; and generating an output signal based on the generated high frequency signal and the low frequency signal obtained from the decoding.

REFERENCE SIGNS LIST

11 Encoding device
32 Low frequency encoding circuit
33 QMF sub-band dividing circuit
34 Feature amount calculating circuit
35 Pseudo high frequency sub-band power calculating circuit
36 Pseudo high frequency sub-band power difference calculating circuit
37 High frequency encoding circuit
38 Multiplexing circuit
51 QMF sub-band power calculation unit
52 High frequency sub-band power calculation unit

The invention claimed is:

1. An encoding device comprising:

circuitry configured to:

divide a frequency band of an input signal and generate a first sub-band signal of a first sub-band on a high frequency side of the input signal;

calculate first sub-band power of the first sub-band signal based on the first sub-band signal;

carry out an operation to weight more the first sub-band power having larger power, and calculate second sub-band power of a second sub-band signal including a number of the continuous first sub-bands by raising a mean value of the first sub-band power raised by the exponent of m by the exponent of 1/m;

generate data to obtain, by estimating, a high frequency signal of the input signal based on the second sub-band power;

encode a low frequency signal of the input signal to generate low frequency encoded data; and multiplex the data and the low frequency encoded data to generate an output code string.

2. The encoding device according to claim 1, wherein the circuitry is further configured to:

calculate pseudo high frequency sub-band power which is an estimated value of the second sub-band power based on the input signal or a feature amount obtained from the low frequency signal, and generate the data by comparing the second sub-band power with the pseudo high frequency sub-band power.

3. The encoding device according to claim 2, wherein the circuitry is further configured to:

calculate the pseudo high frequency sub-band power based on the feature amount and an estimating coefficient preliminarily prepared, and generate the data to obtain any one of a plurality of the estimating coefficients.

4. The encoding device according to claim 3, wherein the circuitry is further configured to:

generate high frequency encoded data by encoding the data, and multiplex the high frequency encoded data and the low frequency encoded data to generate the output code string.

5. The encoding device according to claim 4, wherein the circuitry is further configured to calculate the second sub-band power by obtaining a weighted mean value of the first sub-band power, using the weight which becomes larger as the first sub-band power becomes larger.

6. The encoding device according to claim 1, wherein the circuitry comprises a central processing unit.

7. A computer-implemented encoding method, comprising steps of:

dividing a frequency band of an input signal and generating a first sub-band signal of a first sub-band on a high frequency side of the input signal;

calculating first sub-band power of the first sub-band signal based on the first sub-band signal;

carrying out an operation to weight more the first sub-band power having larger power, and calculating second sub-band power of a second sub-band signal including a number of the continuous first sub-bands by raising a mean value of the first sub-band power raised by the exponent of m by the exponent of 1/m;

generating data to obtain, by estimating, a high frequency signal of the input signal based on the second sub-band power;

encoding a low frequency signal of the input signal to generate low frequency encoded data; and multiplexing the data and the low frequency encoded data to generate an output code string.

8. A non-transitory computer-readable medium storing instructions that, when executed by a computer, cause the computer to execute steps of:

dividing a frequency band of an input signal and generating a first sub-band signal of a first sub-band on a high frequency side of the input signal;

calculating first sub-band power of the first sub-band signal based on the first sub-band signal;

carrying out an operation to weight more the first sub-band power having larger power, and calculating second sub-band power of a second sub-band signal including a number of the continuous first sub-bands by raising a mean value of the first sub-band power raised by the exponent of m by the exponent of 1/m;

generating data to obtain, by estimating, a high frequency signal of the input signal based on the second sub-band power;

encoding a low frequency signal of the input signal to generate low frequency encoded data; and multiplexing the data and the low frequency encoded data to generate an output code string.

9. A decoding device comprising:

circuitry configured to:

demultiplex an input code string into data and low frequency encoded data, wherein the data is generated based on second sub-band power of a second sub-band signal including a number of the continuous first sub-bands on a high frequency side of an input signal, the second sub-band power is calculated by weighting more first sub-band power having larger power among first sub-band power of the first sub-bands and used for obtaining, by estimating, a high frequency signal of the input signal, and the low frequency encoded data is obtained by encoding the low frequency signal of the input signal, the second sub-band power being calculated by raising a mean value of the first sub-band power raised by the exponent of m by the exponent of 1/m;

decode the low frequency encoded data to generate a low frequency signal;

generate a high frequency signal based on an estimating coefficient obtained from the data and the low frequency signal obtained from the decoding; and generate an output signal based on the generated high frequency signal and the low frequency signal obtained from the decoding.

10. The decoding device according to claim 9, wherein the circuitry is further configured to:

calculate an estimated value of the second sub-band power based on a feature amount acquired from a low frequency signal obtained from the decoding and the estimating coefficient, and generate a high frequency signal based on the estimated value of the second sub-band power and the low frequency signal obtained from the decoding.

11. The decoding device according to claim 10, wherein the circuitry is further configured to decode the data and obtain the estimating coefficient.

12. The decoding device according to claim 10, wherein the circuitry is further configured to:

calculate pseudo high frequency sub-band power which is an estimated value of the second sub-band power, based on the input signal or the feature amount obtained from the low frequency signal of the input signal, and generate the data by comparing the second sub-band power with the pseudo high frequency sub-band power.

13. The decoding device according to claim 12, wherein the circuitry is further configured to:

calculate the pseudo high frequency sub-band power based on the input signal or the feature amount obtained from low frequency signal of the input signal and the estimating coefficient preliminarily prepared, and generate the data to obtain any one of a plurality of the estimating coefficients.

14. The decoding device according to claim 10, wherein the circuitry is further configured to:

calculate the second sub-band power by obtaining a weighted mean value of the first sub-band power, using the weight which becomes larger as the first sub-band power becomes larger.

15. The decoding device according to claim 9, wherein the circuitry comprises a central processing unit.

16. A computer-implemented decoding method comprising steps of:

demultiplexing an input code string into data and low frequency encoded data, wherein the data is generated based on second sub-band power of a second sub-band signal including a number of the continuous first sub-bands on a high frequency side of an input signal, the second sub-band power is calculated by weighting more first sub-band power having larger power among first sub-band power of the first sub-bands and used for obtaining, by estimating, a high frequency signal of the input signal, and the low frequency encoded data is obtained by encoding the low frequency signal of the input signal, the second sub-band power being calculated by raising a mean value of the first sub-band power raised by the exponent of m by the exponent of 1/m;

decoding the low frequency encoded data to generate a low frequency signal;

generating a high frequency signal based on an estimating coefficient obtained from the data and the low frequency signal obtained from the decoding; and generating an output signal based on the generated high frequency signal and the low frequency signal obtained from the decoding.

17. A non-transitory computer-readable medium storing instructions that, when executed by a computer, cause the computer to execute steps of:

demultiplexing an input code string into data and low frequency encoded data, wherein the data is generated based on second sub-band power of a second sub-band signal including a number of the continuous first sub-bands on a high frequency side of an input signal, the second sub-band power is calculated by weighting more first sub-band power having larger power among first sub-band power of the first sub-bands and used for obtaining, by estimating, a high frequency signal of the input signal, and the low frequency encoded data is obtained by encoding the low frequency signal of the input signal, the second sub-band power being calculated by raising a mean value of the first sub-band power raised by the exponent of m by the exponent of 1/m;

decoding the low frequency encoded data to generate a low frequency signal;

generating a high frequency signal based on an estimating coefficient obtained from the data and the low frequency signal obtained from the decoding; and generating an output signal based on the generated high frequency signal and the low frequency signal obtained from the decoding.

* * * * *